US011702897B2

(12) United States Patent
von Gynz-Rekowski et al.

(10) Patent No.: US 11,702,897 B2
(45) **Date of Patent: *Jul. 18, 2023**

(54) BIT SAVER ASSEMBLY AND METHOD

(71) Applicant: Workover Solutions, Inc., Imperial, PA (US)

(72) Inventors: Gunther H H von Gynz-Rekowski, Montgomery, TX (US); Russell Wayne Koenig, Conroe, TX (US)

(73) Assignee: Workover Solutions, Inc., Imperial, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/577,831

(22) Filed: Jan. 18, 2022

(65) Prior Publication Data

US 2022/0136346 A1 May 5, 2022

Related U.S. Application Data

(63) Continuation of application No. 17/065,138, filed on Oct. 7, 2020, now Pat. No. 11,261,681.

(51) Int. Cl.
*E21B 21/10* (2006.01)
*E21B 21/08* (2006.01)

(52) U.S. Cl.
CPC ..... *E21B 21/103* (2013.01); *E21B 21/08* (2013.01); *E21B 21/10* (2013.01); *E21B 2200/06* (2020.05)

(58) Field of Classification Search
CPC .... E21B 21/103; E21B 21/08; E21B 2200/06; E21B 12/04; E21B 44/00; E21B 21/00; E21B 21/10
See application file for complete search history.

(56) References Cited

U.S. PATENT DOCUMENTS

| | | | | |
|---|---|---|---|---|
| 4,281,726 | A | 8/1981 | Garrett | |
| 4,768,598 | A | 9/1988 | Reinhardt | |
| 4,901,806 | A | 2/1990 | Forrest | |
| 5,174,392 | A | 12/1992 | Reinhardt | |
| 6,675,897 | B1 | 1/2004 | McGarian et al. | |
| 8,714,284 | B2 | 5/2014 | Cote | |
| 10,544,637 | B2 | 1/2020 | Cramer et al. | |
| 11,261,681 | B1 * | 3/2022 | von Gynz-Rekowski | E21B 12/04 |
| 2012/0067645 | A1 | 3/2012 | Cote | |
| 2014/0284112 | A1 * | 9/2014 | Cenac | E21B 21/10 175/317 |
| 2017/0342781 | A1 | 11/2017 | Reimers | |
| 2019/0024459 | A1 | 1/2019 | Sicilian et al. | |

OTHER PUBLICATIONS

Co-pending parent U.S. Appl. No. 17/065,138, filed Oct. 7, 2020.
International Search report and Written Opinion dated Jul. 16, 2021, from Applicant's counterpart International Patent Application No. PCT/US2021/027711.

* cited by examiner

*Primary Examiner* — Brad Harcourt
(74) *Attorney, Agent, or Firm* — Jones Walker LLP

(57) ABSTRACT

A bit saver assembly having an inner valve sleeve that actuates upon the weight-on-bit (WOB) of the drill bit exceeding a threshold value to overcome the countervailing force provided by a spring contained within the bit saver assembly and the internal flow pressure of the drilling fluid at the area of the inner valve sleeve. Actuation of the inner valve sleeve opens a fluid passage to the wellbore annulus resulting in a reduction of drilling fluid flow pressure and the stretch of the drill string thereby reducing WOB of the drill bit without operator assistance.

20 Claims, 16 Drawing Sheets

$$x = \frac{WOB - (P * A_V + k * x_p)}{k}$$

$$x_p \geq 0$$

$$0 \leq x \leq \max travel$$

WOB=Weight on Bit

P=Flow Pressure $A_v$ = Valve Area

K=spring rate $X_p$= Preload distance

*Fig. 15*

BIT SAVER ASSEMBLY AND METHOD

CROSS-REFERENCE TO RELATED APPLICATIONS

This application is a continuation of and claims priority to U.S. patent application Ser. No. 17/065,138, filed on Oct. 7, 2020, which is incorporated by reference herein.

FIELD OF THE INVENTION

The present invention relates to a bit saver assembly and method for managing the weight-on-bit (WOB) during wellbore drilling operations and notifying the driller when the WOB limit has been reached. More particularly, the present invention relates to a bit saver assembly and method for managing the WOB through altering internal flow pressure.

BACKGROUND OF THE INVENTION

In the process of drilling oil and gas wells, force is applied to the drill bit to break rock at the bottom of the wellbore. Such force is applied by drill collars within the drill string. Drill collars are thick-walled tubulars machined from solid bars of steel. Drill collars are positioned on the drill string proximate to the drill bit. The drill collars, together with the drill bit, bit sub, mud motor, stabilizers, heavy-weight drill pipe, jarring devices ("jars") and crossovers for various thread forms comprises what is known as the "bottom hole assembly." The bottom hole assembly must transmit force to the drill bit to break the rock (weight-on-bit), survive a hostile mechanical environment and provide the driller with directional control of the well. Gravity acts on the drill collars to apply downward force required for the drill bit to efficiently break rock. Weight-on-bit or WOB is the amount of axial force exerted on the drill bit. To control the WOB, a driller monitors the surface weight (weight of the hanging drill string) measured while the drill bit is just off the bottom of the wellbore. The driller lowers the drill string until the drill bit touches the wellbore's bottom. As the drill string is further lowered, the drill bit receives more WOB. Less weight is measured as hanging from the surface. For a vertical wellbore, if the surface measurement reads 2,000 kg less weight of the drill string while drilling, there should be 2,000 kg of force transmitted to the drill bit.

Drilling fluids or mud are pumped from the surface through a central bore extending through the drill string to the drill bit. Drilling fluids lubricate and cool the drill bit while drilling to prevent wear. The drilling fluids also return to the surface through the annulus carrying cuttings away from the drill bit.

There exists an optimal range of WOB values based on the style, size and brand of drill bit being used, the depth of drilling, weight of the drilling mud, and the characteristics of the geological formations to be drilled through. If WOB is more than the upper limit of the optimal range, there is a greater chance the drill bit may incur excessive wear or damage. If WOB is less than the lower limit of the optimal range, the rate of penetration into the formation is reduced resulting in increased rig time and costs. Drill bit manufacturers typically specify the maximum WOB for a particular drill bit.

SUMMARY OF THE INVENTION

The present invention is drawn to an embodiment of a bit saver assembly that may comprise an outer housing including an inner bore defined by an inner bore wall. The outer housing may include one or more apertures for the passage of a drilling fluid to an annulus of a wellbore. The assembly may also have an outer valve sleeve including an inner bore defined by an inner bore wall. The outer valve sleeve may be contained within the inner bore of the outer housing and may be fixed to the inner bore wall of the outer housing. The outer valve sleeve may include one or more apertures for the passage of the drilling fluid to the one or more apertures of the outer housing. The assembly may also have an inner assembly selectively movable axially in relation to the outer valve sleeve and being partially contained within the inner bore of the outer housing. The inner assembly may include an inner valve sleeve positioned within the inner bore of the outer valve sleeve. The inner valve sleeve may include one or more apertures for the selective passage of the drilling fluid to the one or more apertures of the outer valve sleeve. The inner valve sleeve may have a non-actuated position wherein the one or more apertures of the inner valve sleeve are not in fluid communication with the one or more apertures of the outer valve sleeve and an actuated position wherein the one or more apertures of the inner valve sleeve are in fluid communication with the one or more apertures of the outer valve sleeve. The inner assembly may have a spring positioned within the inner bore of the outer housing and operatively connected to the inner valve sleeve. The spring may have a preload force. The inner assembly may be operatively connected to a drill bit and configured to place the one or more apertures of the inner valve sleeve in the non-actuated position based on a weight-on-bit (WOB) force on the drill bit being less than a countervailing force comprising the preload force of the spring plus a drilling fluid flow pressure at an area proximate the inner valve sleeve and to place the one or more apertures of the inner valve sleeve in the actuated position based on a the WOB force being greater than the countervailing force.

In another embodiment of the bit saver assembly, the inner assembly may include a spring mandrel positioned within the inner bore of the outer housing. The spring mandrel may be operatively connected to the inner valve sleeve and to the spring. The spring may be positioned around a portion of the spring mandrel.

In yet another embodiment of the bit saver assembly, the inner assembly may include a spline mandrel. The spline mandrel may be partially positioned within the inner bore of the outer housing. The spline mandrel may have an upper end operatively contacting a lower end of the spring mandrel. The spline mandrel may have a lower end operatively connected to the drill bit.

In yet another embodiment of the bit saver assembly, the inner assembly may include a mandrel nut operatively positioned within the bore of the outer housing between the upper end of the spline mandrel and the inner bore wall of the outer housing. The mandrel nut may be directly connected to the upper end of the spline mandrel and movable therewith. The mandrel nut may be configured to hold the lower end of the spring mandrel onto the upper end of the spline mandrel.

In yet another embodiment of the bit saver assembly, the inner assembly may include a lower spring spacer operatively positioned within the inner bore of the outer housing between the spring mandrel and the inner bore wall of the outer housing. A bottom end of the lower spring spacer may contact an upper end of the mandrel nut and be movable therewith. An upper end of the spring spacer may contact a lower end of the spring.

In yet another embodiment of the bit saver assembly, the assembly may further comprise an upper spring spacer operatively positioned within the inner bore of the outer housing. The upper spring spacer may be affixed to the outer housing. A lower end of the upper spring spacer may contact an upper end of the spring.

In yet another embodiment of the bit saver assembly, the inner assembly may include a spring nut operatively positioned within the inner bore of the outer housing partially between the spring mandrel and the inner bore wall of the outer housing. The spring nut may directly connect to an upper end of the spring mandrel.

In yet another embodiment of the bit saver assembly, the assembly may further comprise a compression nut fixedly attached to the inner bore wall of the outer housing. The compression nut may have an inner bore defined by an inner bore wall. The inner bore of the compression nut may be dimensioned to receive an upper section of the spring nut when the inner valve sleeve is in the actuated position.

In yet another embodiment of the bit saver assembly, the upper section of the spring nut may directly connect to a lower end of the inner valve sleeve.

In yet another embodiment of the bit saver assembly, the upper end of the spline mandrel may include a seal. The seal may provide a sealed connection between the spline mandrel and mandrel nut.

In yet another embodiment of the bit saver assembly, the upper end of the outer valve sleeve may contain a seal and the lower end of the outer valve sleeve may contain a seal. The seals may provide a sealed connection between the outer valve sleeve and the outer housing. The one or more apertures of the outer valve sleeve may be positioned between the seals of the upper and lower ends of the outer valve sleeve.

In yet another embodiment of the bit saver assembly, the portion of the lower end of the spline mandrel not contained within the inner bore of the outer housing may include a rib. The rib may have an upper shoulder that abuts with the lower terminating edge of the outer housing when the inner valve sleeve is in the actuated position.

In yet another embodiment of the bit saver assembly, the outer housing may comprise an upper body, a spring housing, and a spline body. A lower end of the upper body may directly connect to an upper end of the spring housing. A lower end of the spring housing may directly connect to an upper end of the spline body.

The present invention is also drawn to an embodiment of a method of managing a weight-on-bit (WOB) force on a drill bit during a drilling operation. The method may comprise step (a) of running a drill string down a wellbore, the drill string terminating at a bottom-hole assembly (BHA) that includes the drill bit. The drill string may include a bit saver assembly as described above operatively positioned above the BHA. The method may include step (b) of placing the drill bit in contact with the bottom of the wellbore. The method may comprise step (c) of causing the drill bit to bore into the bottom of the wellbore, the drill bit being subjected to the WOB force. The method may comprise step (d) of reducing the WOB force on the drill bit while the drill bit bores into the bottom of the wellbore by causing the inner valve sleeve to move from the non-actuated position to the actuated position when the WOB force becomes greater than the countervailing force.

In another embodiment of the method, as part of step (d), the inner valve sleeve may move upwardly in relation to the outer valve sleeve to align the one or more apertures of the inner valve sleeve with the one or more apertures of the outer valve sleeve.

In yet another embodiment of the method, the drilling fluid flow from the inner bore of the outer housing to the annulus may cause a reduction of the drilling fluid flow pressure acting upon the BHA.

In yet another embodiment of the method, a pressure gauge on the drilling ring may indicate the reduction of the drilling fluid pressure acting upon the BHA.

In yet another embodiment of the method, the method may further comprise step (e) of lifting the drill bit off the bottom of the wellbore to cause the inner valve sleeve to return to the non-actuated position when the WOB force becomes less than the countervailing force.

In yet another embodiment of the method, the bit saver assembly may further reduce dynamic WOB due to bit bouncing and stick-slip by means of providing a counteractive spring load. As for example, wherein with respect to the bit saver assembly: the inner assembly includes a spring mandrel positioned within the inner bore of the outer housing, the spring mandrel is operatively connected to the inner valve sleeve and to the spring, the spring being positioned around a portion of the spring mandrel; the inner assembly includes a spline mandrel, the spline mandrel partially positioned within the inner bore of the outer housing, the spline mandrel having an upper end operatively contacting a lower end of the spring mandrel, the spline mandrel having a lower end operatively connected to the drill bit; the inner assembly includes a mandrel nut operatively positioned within the bore of the outer housing between the upper end of the spline mandrel and the inner bore wall of the outer housing, the mandrel nut being directly connected to the upper end of the spline mandrel and movable therewith, the mandrel nut configured to hold the lower end of the spring mandrel onto the upper end of the spline mandrel; the method may comprises the step of the bit saver assembly generating a dampening effect during drilling that minimizes dynamic changes in WOB and bit bounce to prevent inadvertent movement of the inner valve sleeve from the non-actuated position to the actuated position. The dampening effect may be initiated by limiting travel of the drilling fluid captured in a cavity at an area of the spring through a first annular gap between the mandrel nut and the spring housing and again through a second annular gap between the spline mandrel and the spline body.

BRIEF DESCRIPTION OF THE DRAWINGS

FIG. 15 is a chart of the Distance Traveled Formula.

DETAILED DESCRIPTION OF THE PREFERRED EMBODIMENTS

With reference to the figures where like elements have been given like numerical designation to facilitate an understanding of the present invention, and particularly with reference to the embodiment of the bit saver sub assembly 10 depicted in FIGS. 1A-4, assembly 10 is shown as it would be configured without weight-on-bit (WOB), i.e. the drill bit off the bottom of the wellbore.

Figure 1A:
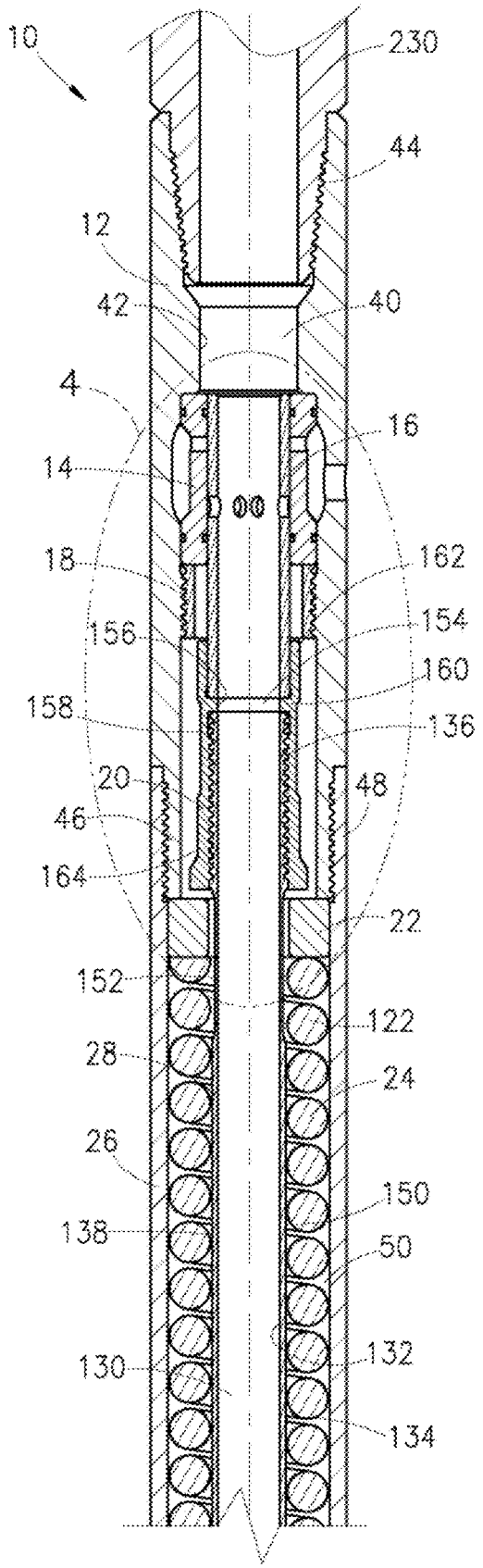
FIGS. 1A and 1B are cross-sectional, sequential views of an embodiment of the bit saver assembly in a No WOB configuration.
Figure 1B:
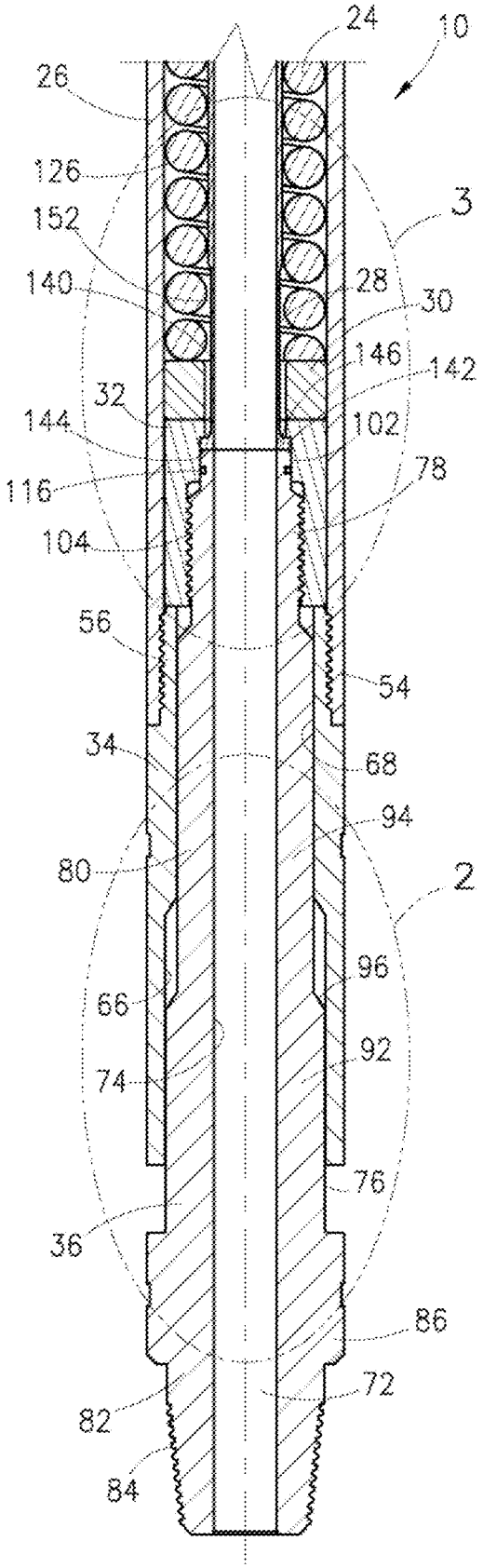
Figure 2:
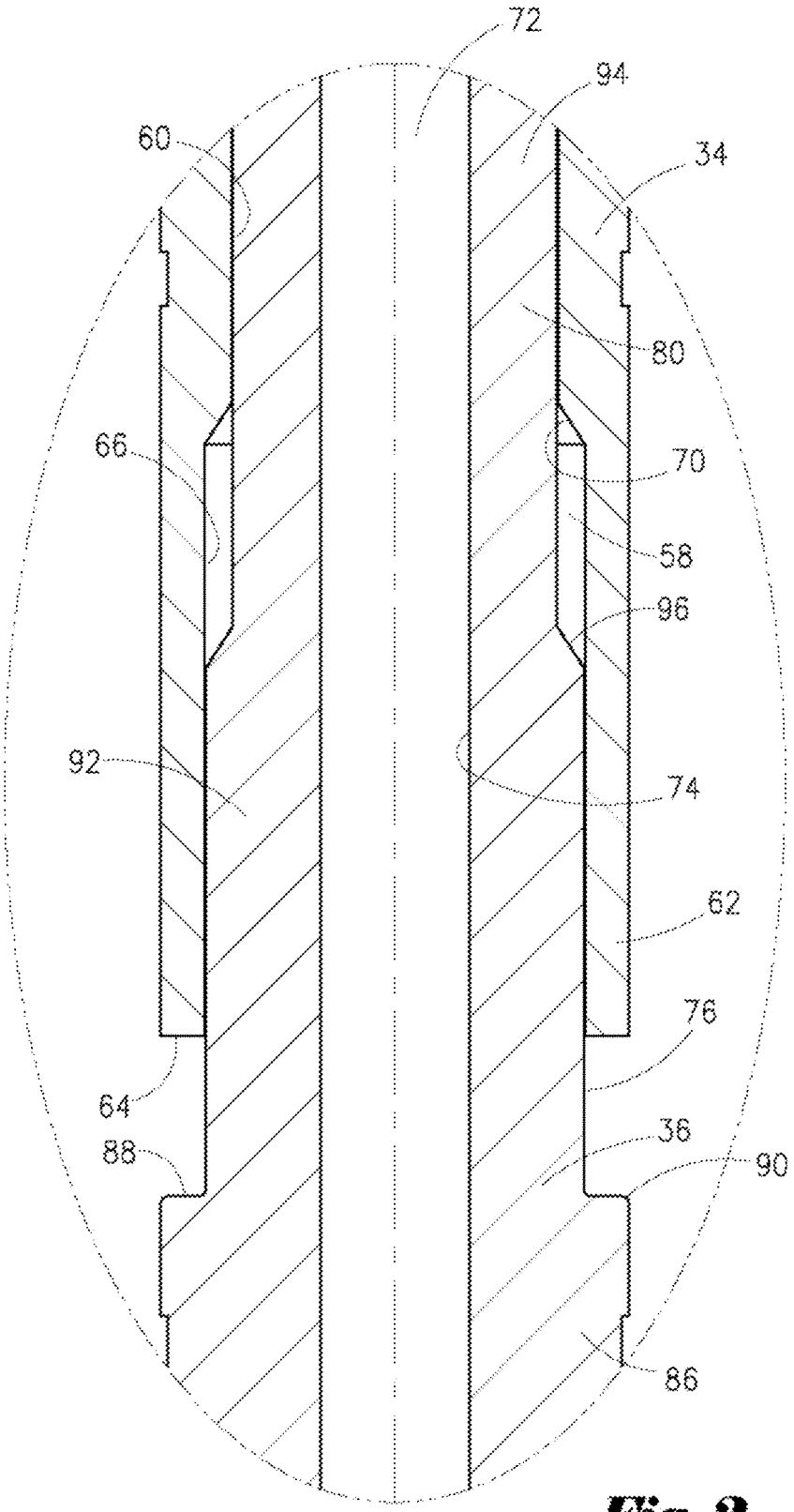
FIG. 2 is partial cross-sectional view of the lower section of the embodiment of bit saver assembly of FIGS. 1A and 1B.
Figure 4:
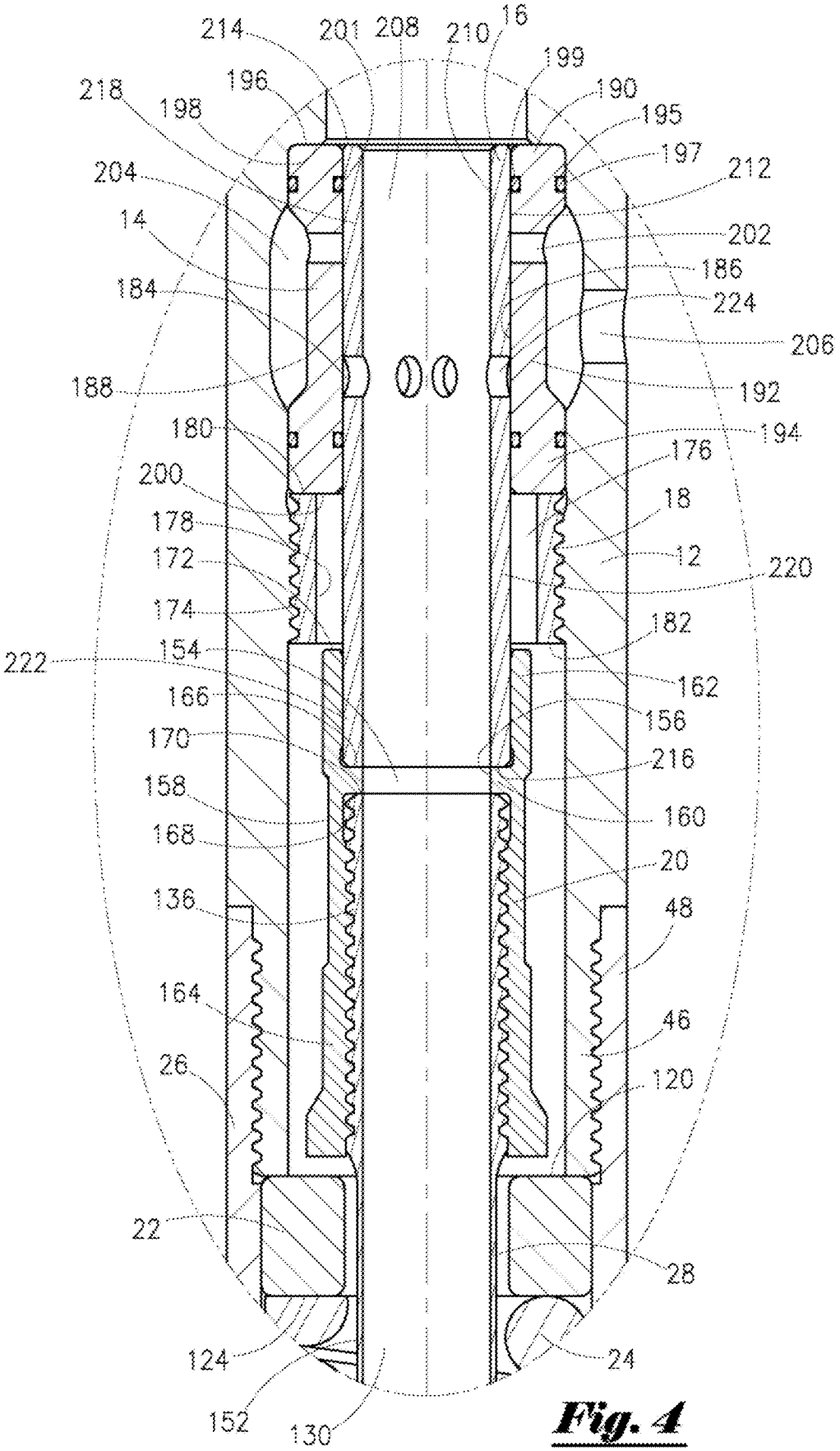
FIG. 4 is a partial cross-sectional view of the upper section of the embodiment of the bit saver assembly of FIGS. 1A and 1B.
Figure 5A:
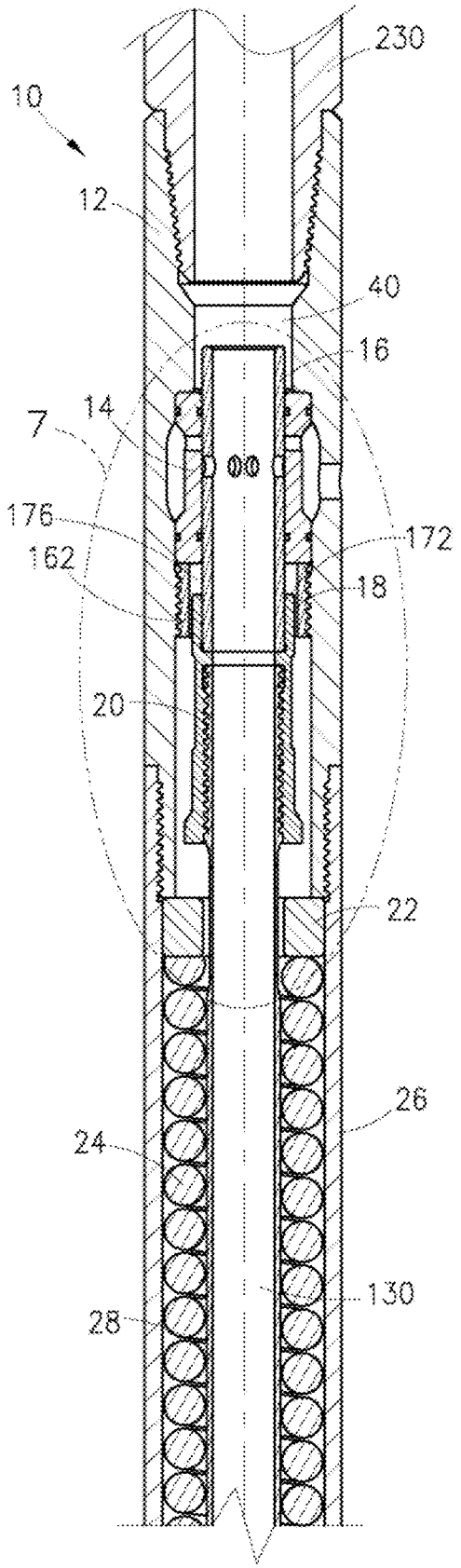
FIGS. 5A and 5B are cross-sectional, sequential views of an embodiment of the bit saver assembly in a First WOB configuration (some WOB).
Figure 5B:
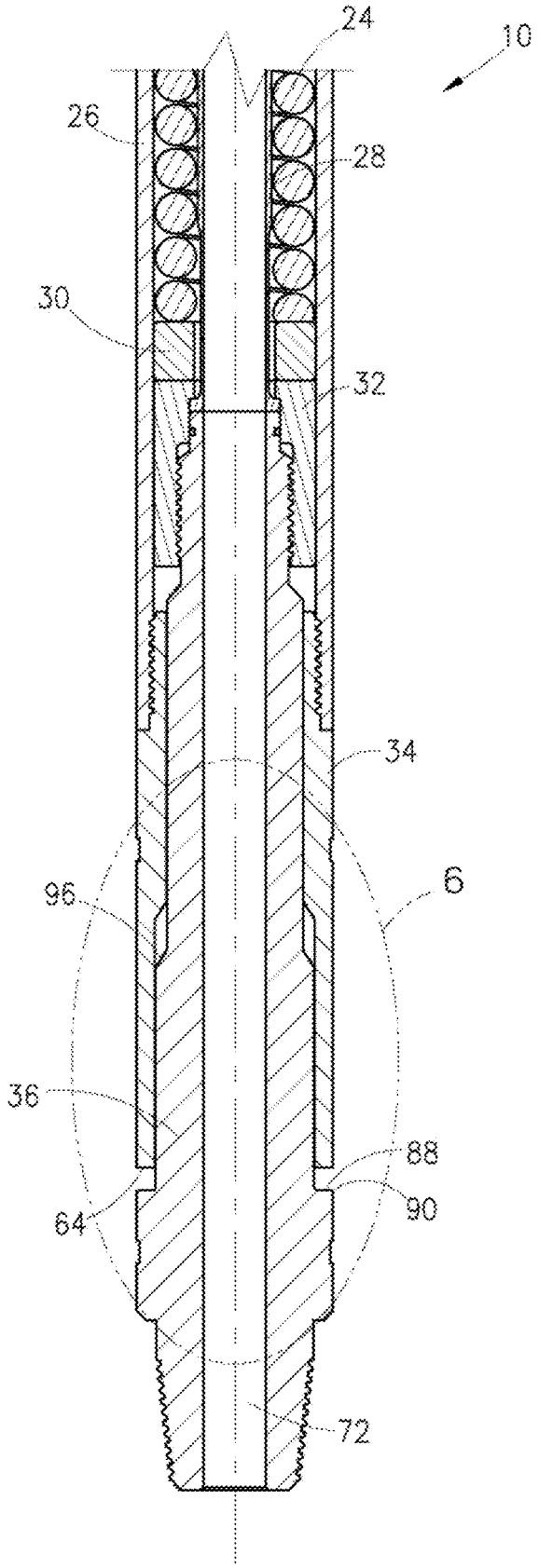
Figure 6:
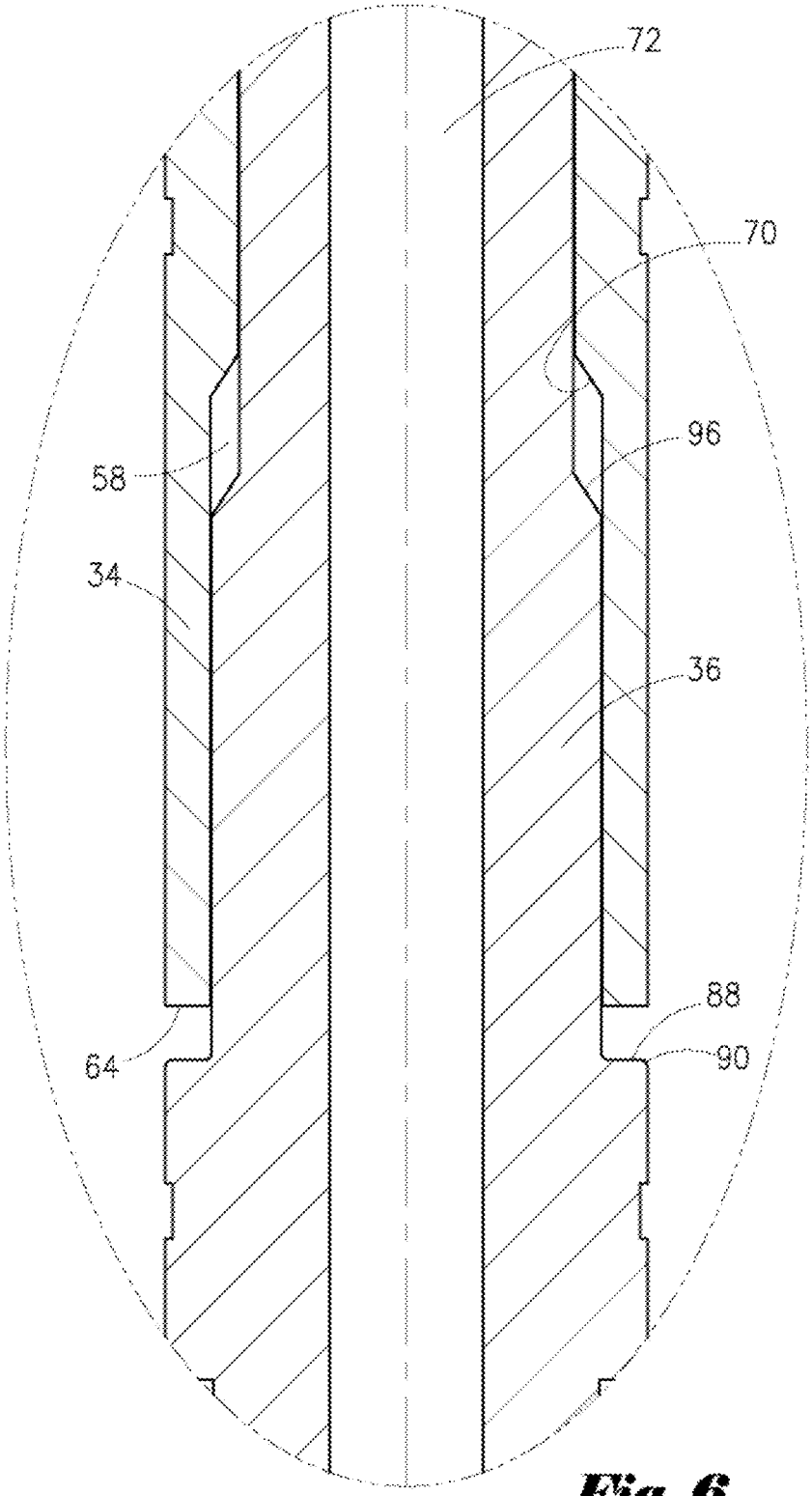
FIG. 6 is partial cross-sectional view of the lower section of the embodiment of bit saver assembly of FIGS. 5A and 5B.
Figure 7:
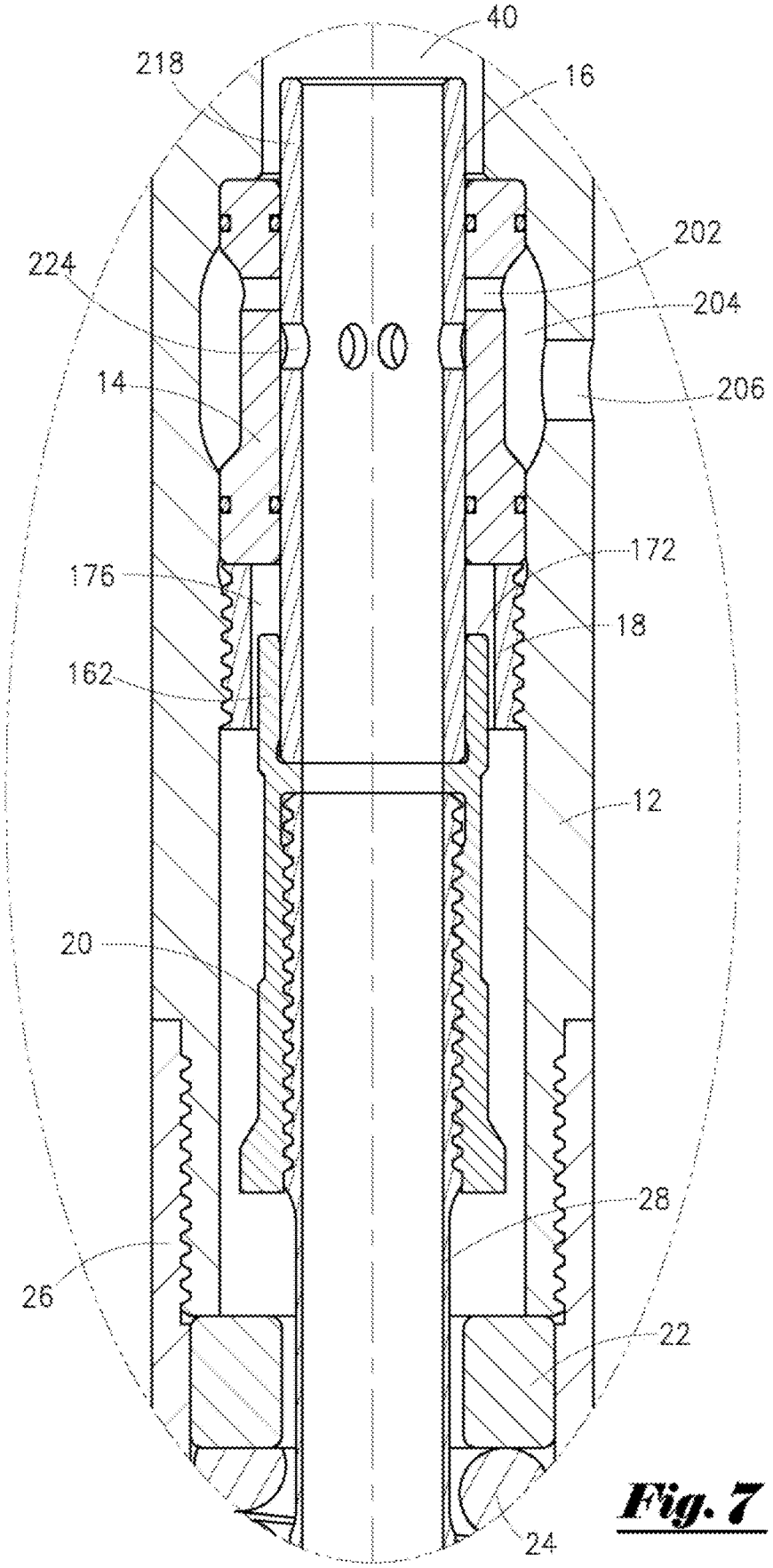
FIG. 7 is a partial cross-sectional view of the upper section of the embodiment of the bit saver assembly of FIGS. 5A and 5B.
Figure 8A:
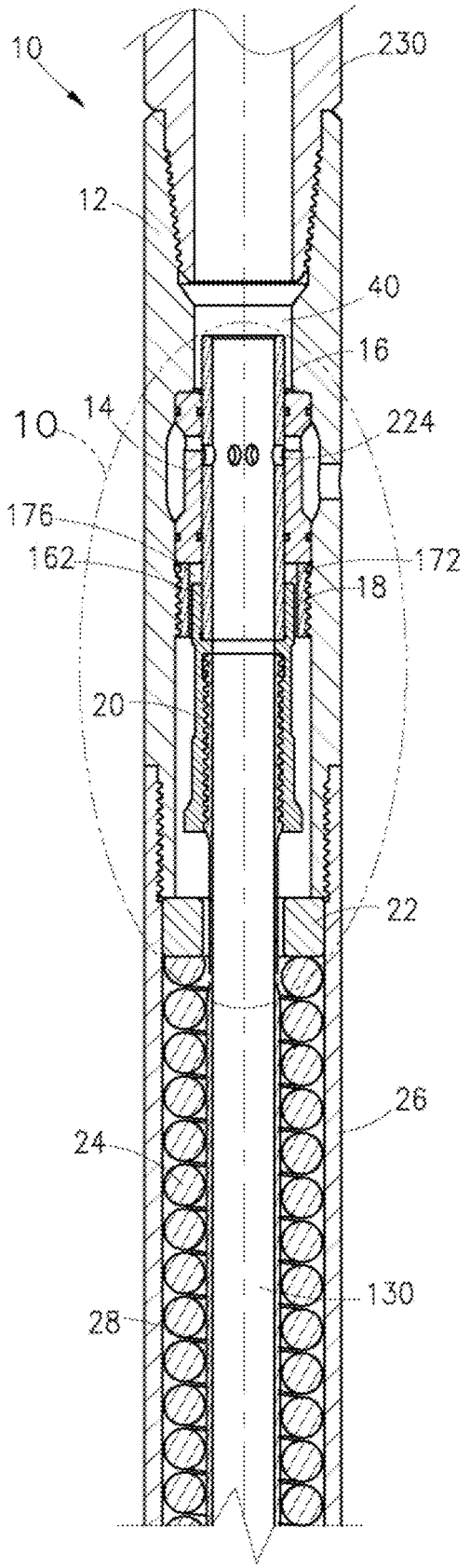
FIGS. 8A and 8B are cross-sectional, sequential views of an embodiment of the bit saver assembly in a Second WOB configuration (crack-open).
Figure 8B:
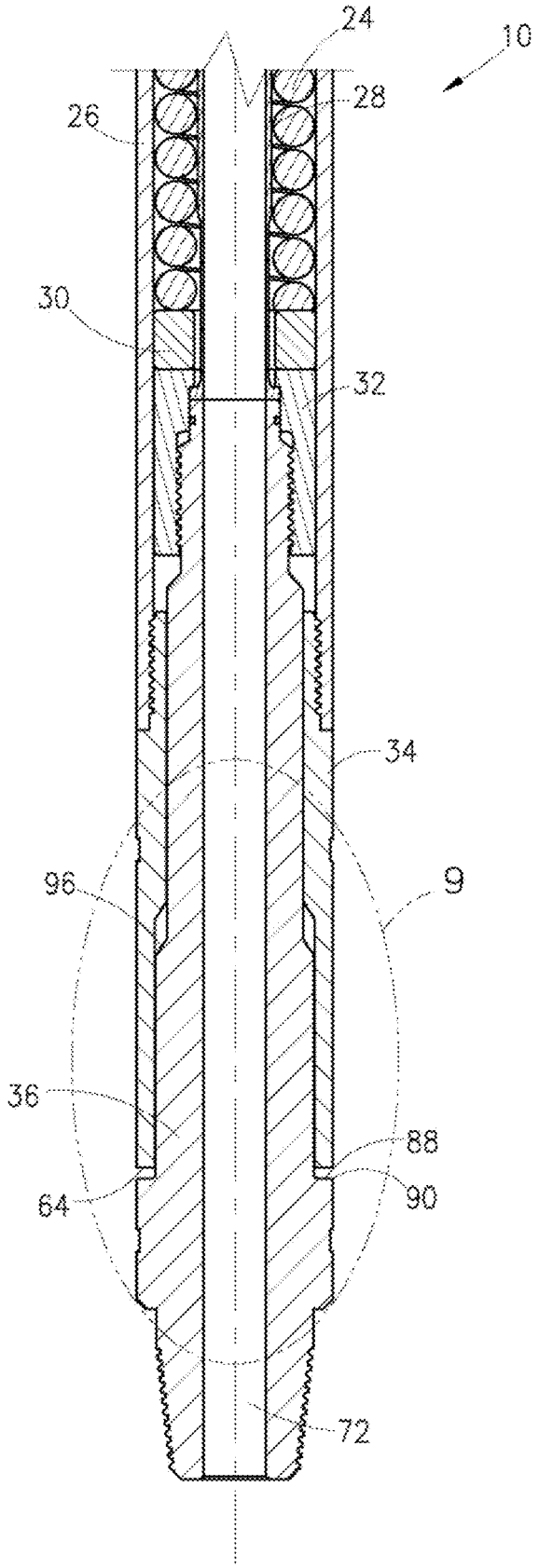
Figure 9:
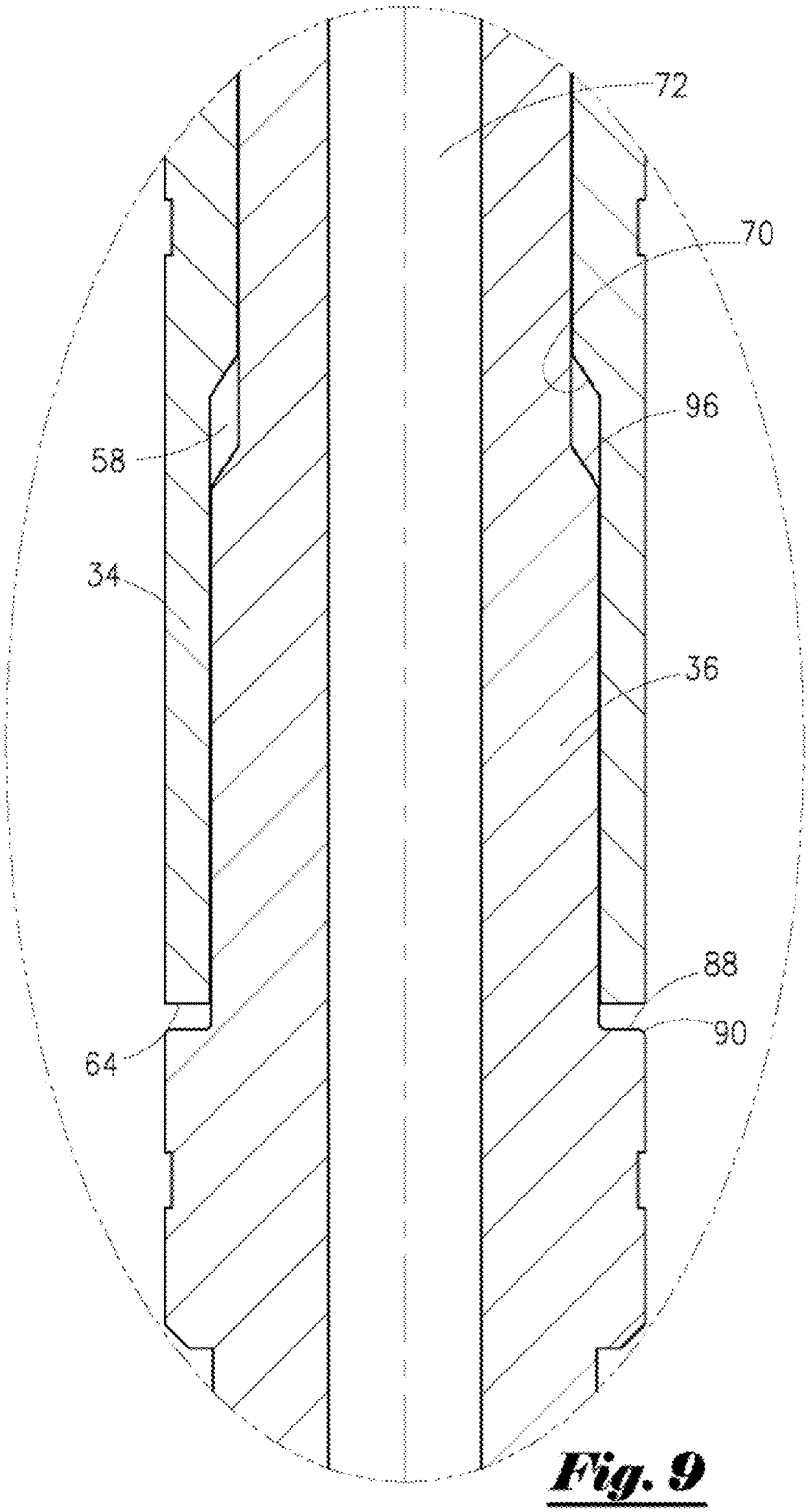
FIG. 9 is partial cross-sectional view of the lower section of the embodiment of bit saver assembly of FIGS. 8A and 8B.
Figure 10:
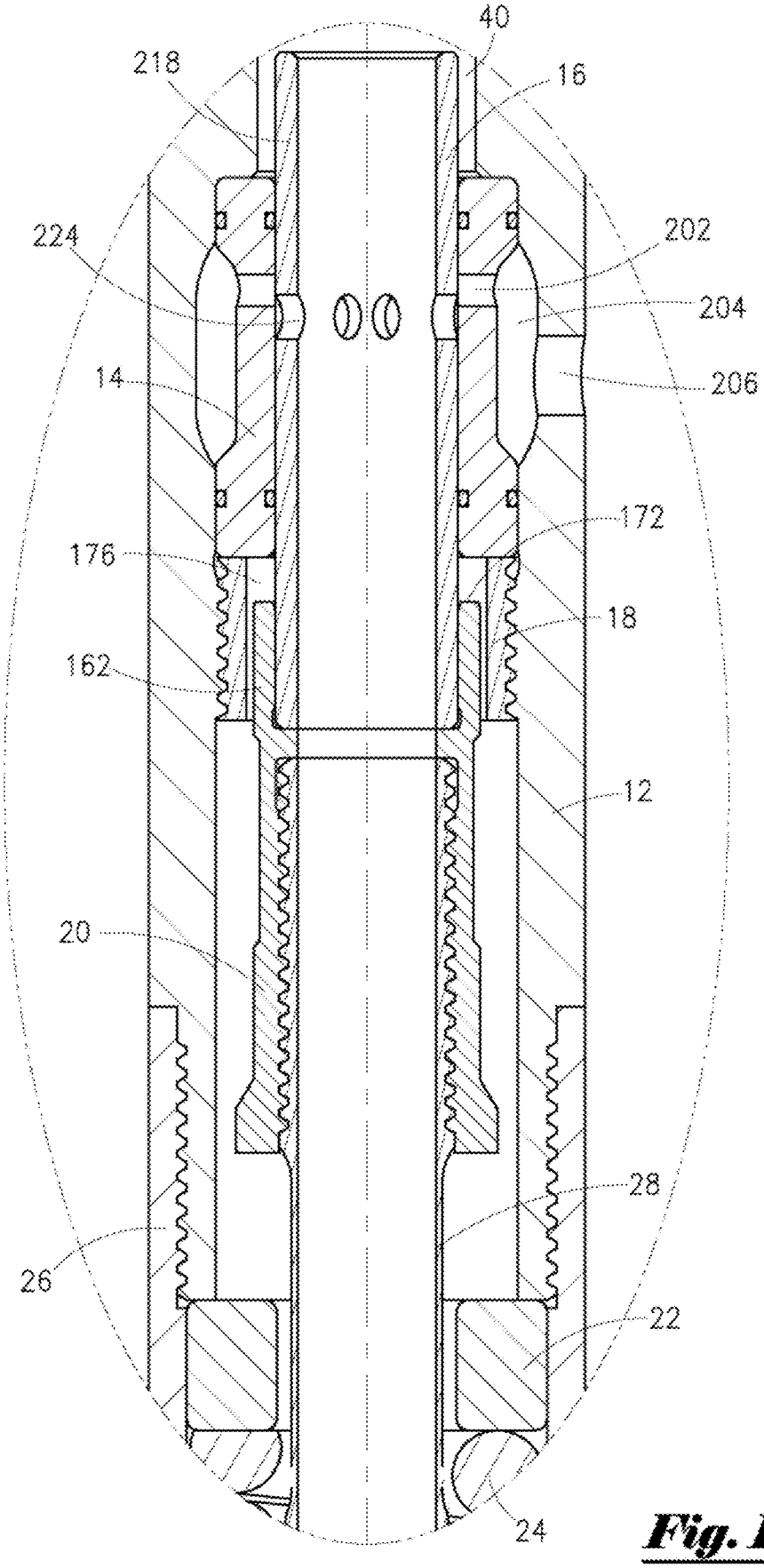
FIG. 10 is a partial cross-sectional view of the upper section of the embodiment of the bit saver assembly of FIGS. 8A and 8B.
Figure 11A:
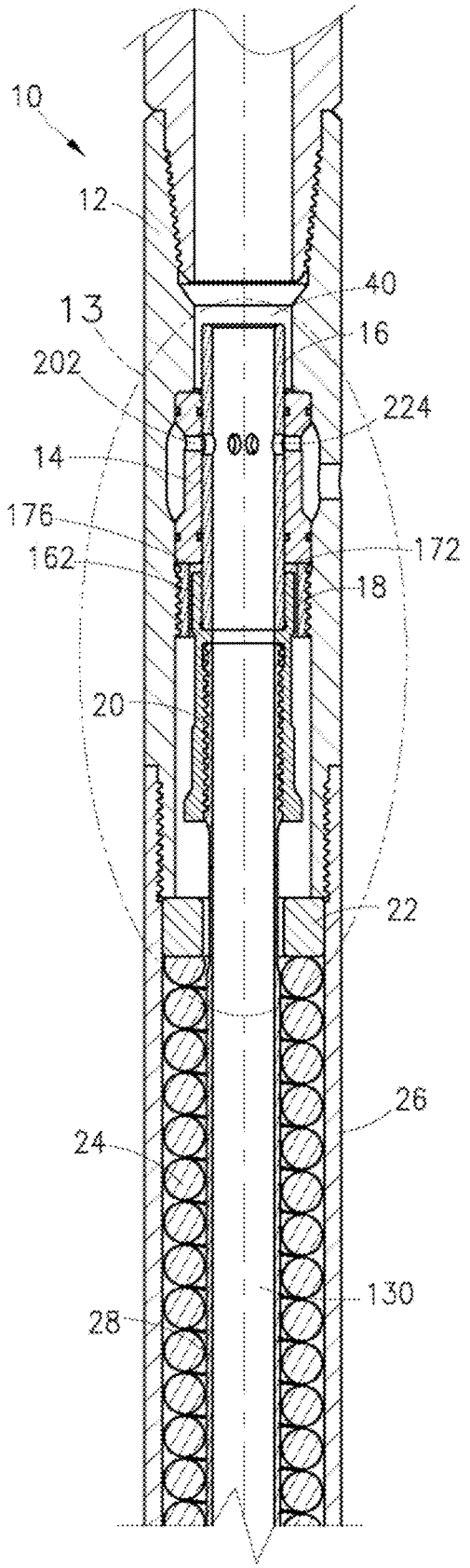
FIGS. 11A and 11B are cross-sectional, sequential views of an embodiment of the bit saver assembly in a Max WOB configuration (latched-open).
Figure 11B:
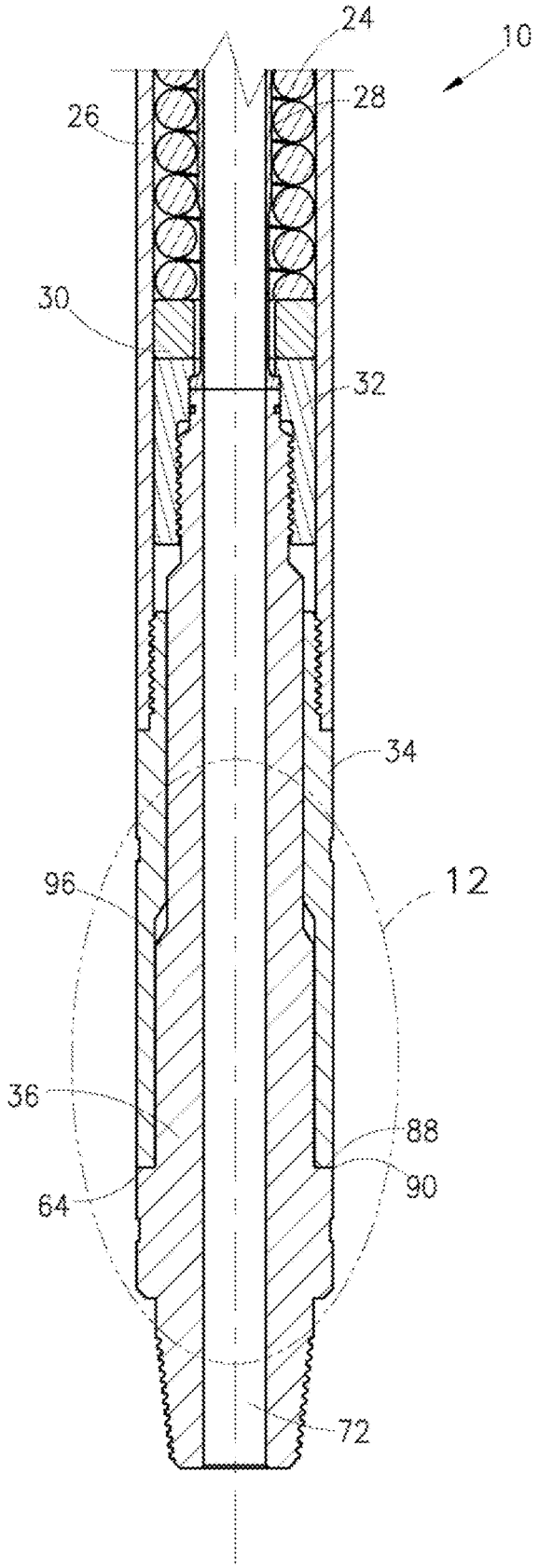
Figure 12:
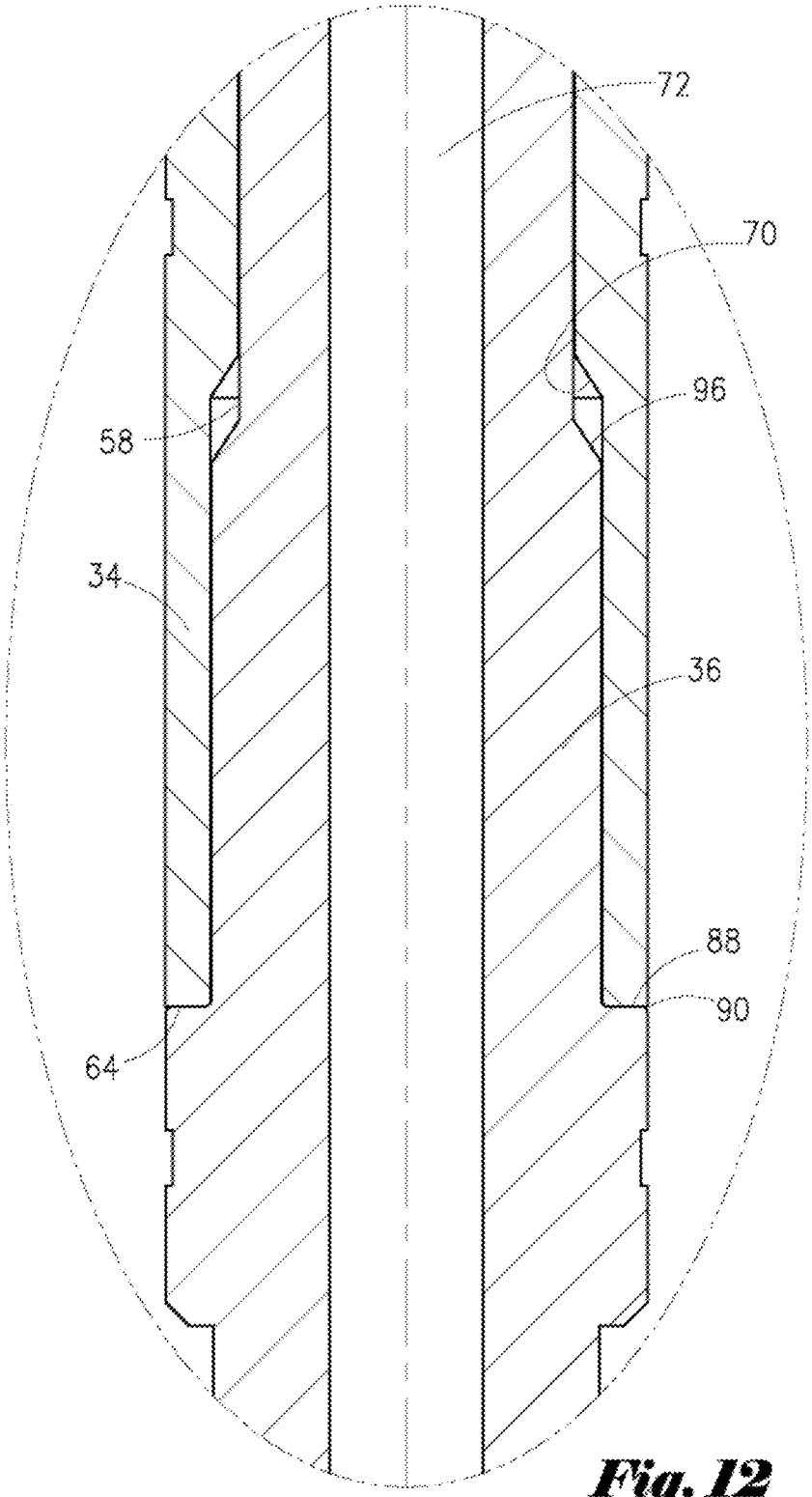
FIG. 12 is partial cross-sectional view of the lower section of the embodiment of bit saver assembly of FIGS. 11A and 11B.
Figure 13:
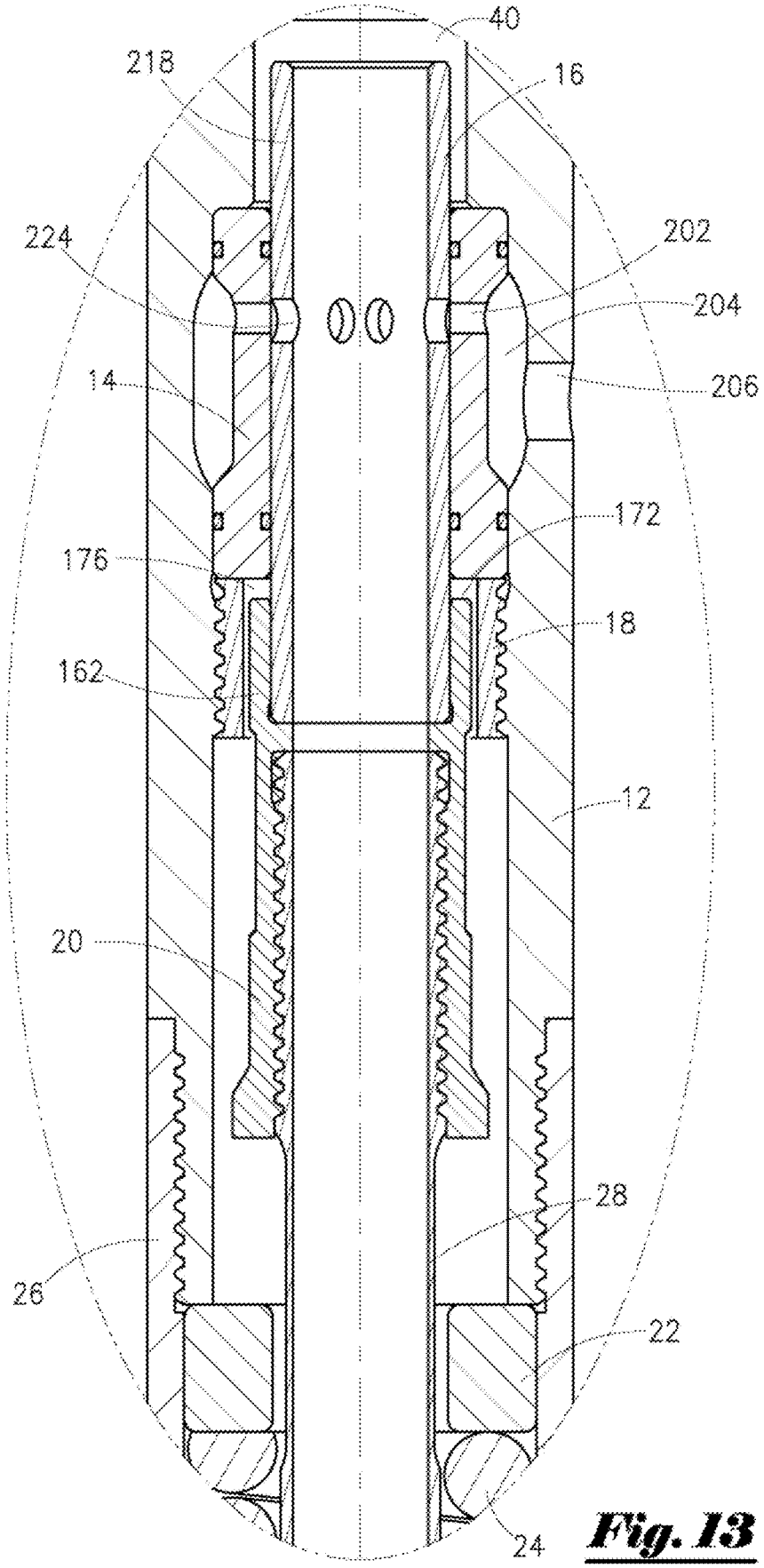
FIG. 13 is a partial cross-sectional view of the upper section of the embodiment of the bit saver assembly of FIGS. 11A and 11B.

As shown in FIGS. 1A, 1B, and 4, assembly 10 may include upper body 12. Upper body 12 may be tubular in design with inner bore 40 defined by inner bore wall 42. Upper body 12 may have upper box end 44 and lower pin end 46. Upper box end 44 may receive in operative connection (e.g. threaded connection) a drill pipe or coiled tubing (not shown) otherwise referred to herein as drill string extending from a drilling rig through a well bore to the assembly 10. Lower pin end 46 may be operatively connected (e.g. threaded connection) to upper box end 48 of spring housing 26.

Figure 3:
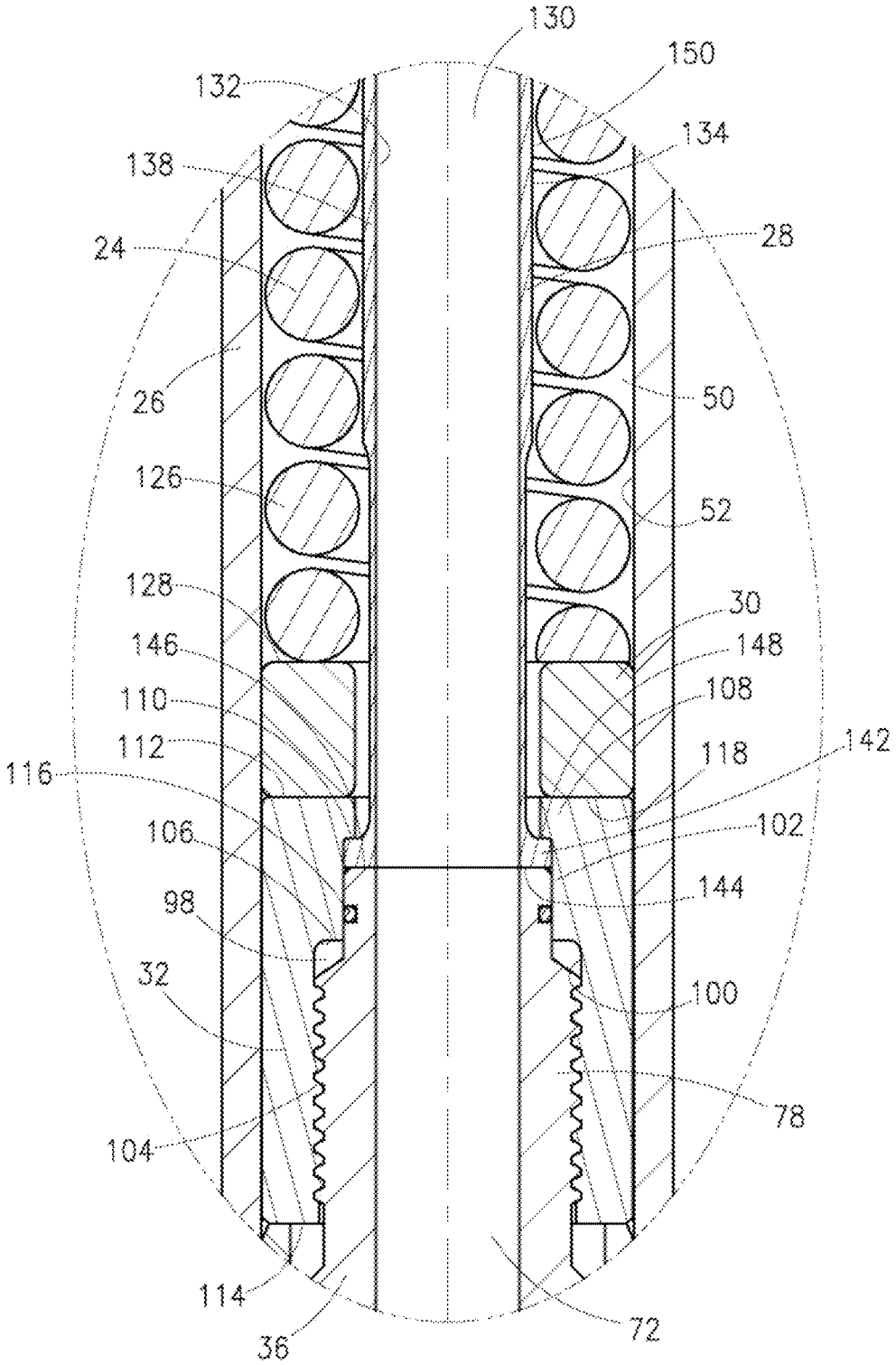
FIG. 3 is a partial cross-sectional view of the lower middle section of the embodiment of the bit saver assembly of FIGS. 1A and 1B.

With reference to FIGS. 1A, 1B, and 3, spring housing 26 may be tubular in design with inner bore 50 defined by inner bore wall 52. Lower box end 54 of spring housing 26 may receive in operative connection (e.g. threaded connection) upper pin end 56 of spline body 34.

As seen in FIGS. 1A-3, spline body 34 may be tubular in design with inner bore 58 defined by inner bore wall 60. Lower end 62 of spline body 34 may terminate at lower edge 64. Inner bore wall 60 may be divided into lower section 66 and upper section 68. Lower section 66 may have an inner diameter greater than an inner diameter of upper section 68. The transition from lower section 66's enlarged inner diameter to upper section 68's smaller inner diameter may occur at tapered shoulder 70.

With further reference to FIGS. 1A-3, assembly 10 may include spline mandrel 36. Spline mandrel 36 may be substantially tubular in design with inner bore 72 defined by inner bore wall 74. Spline mandrel 36 may include outer surface 76. Spline mandrel 36 may include upper section 78, middle section 80 and lower section 82. Lower section 82 may contain pin end 84 that operatively connects (e.g. threaded connection) with a bottom-hole assembly (BHA) (the BHA terminates at the drill bit). Lower section 82 may also contain rib member 86 extending outwardly from outer surface 76. Upper edge 88 of rib member 86 may contain shoulder 90. Outer surface 76 at lower section 82 may also contain enlarged outer diameter section 92. Outer surface 76 at middle section 80 may contain smaller outer diameter section 94. The transition between enlarged outer diameter section 92 and smaller outer diameter section 94 may occur at tapered shoulder 96. Enlarged outer diameter section 92 may be dimensioned so as to be accommodated within the enlarged inner diameter of lower section 66 of spline body 34. Smaller outer diameter section 94 may be dimensioned so as to be accommodated within the smaller inner diameter of upper section 68 of spline body 34. Outer surface 76 of spline mandrel may be profiled with splines (not shown) that interface with spline recesses (not shown) profiled in inner bore wall 60 of spline body 34 so as to provide operative connection between spline body 34 and spline mandrel 36 while permitting spline mandrel 36 to move axially in relation to spline body 34.

As seen in FIGS. 1A, 1B, and 3, mandrel nut 32 may be tubular in design with inner bore 98 defined by inner bore wall 100. Spring mandrel 32 may be positioned within inner bore 50 of spring housing 26 between inner bore wall 52 of spring housing 26 and outer surface 76 of upper section 78 of spline mandrel 36. Inner bore wall 100 may include upper section 102 and lower section 104. Lower section 104 may contain an enlarged inner diameter in relation to the inner diameter of upper section 102. Tapered shoulder 106 may be transitioned between upper section 102 and lower section 104. Upper section 102 may include upper edge section 108. The inner diameter of upper edge section 108 may be reduced in relation to the inner diameter of upper section 102. Shoulder 110 may transition between upper section 102 and upper edge section 108. Spring mandrel 32 may also include upper end 112 and lower end 114. Lower end 114 may abut upper pin end 56 of spline body 34. Spring mandrel 32 may be operatively connected (e.g. by threaded connection) to spline mandrel 36. For example, lower section 104 may contain threads that mate with threads contained on outer surface 76 of upper section 78 of spline mandrel 36. Spring mandrel 32 and spline mandrel 36 may be sealingly connected. As for example, a seal (such as an O-ring 116) may be positioned on outer surface 76 of upper section 78 of spline mandrel 36 and sealingly engages with upper section 102 of mandrel nut 32.

FIGS. 1A, 1B, and 3 illustrate that spring 24 may be positioned within inner bore 50 of spring housing 26 and sandwiched between upper spring spacer 22 and lower spring spacer 30. Lower end 118 of lower spacer 30 may abut against upper end 112 of mandrel nut 30. Upper end 120 of upper spring spacer 22 may abut against lower pin end 46 of upper body 12. Upper end 122 of spring 24 may compress against lower end 124 of upper string spacer 22. Lower end 126 of spring 24 may compress against upper end 128 of lower spacer 30.

With reference to FIGS. 1A, 1B, 3, and 4, spring mandrel 28 may be tubular in design with inner bore 130 defined by inner bore wall 132. Spring mandrel 28 may have outer surface 134. Spring mandrel 28 may include upper section 136, middle section 138 and lower section 140. Lower section 140 may terminate at flanged end section 142.

Flanged end section 142 may include lower end 144 that abuts against top edge 146 of upper section 78 of spline mandrel 36. Lower section 140 and middle section 138 may be positioned within inner bore 50 of spring housing 26. Outer surface 134 at flanged end section 142 may set adjacent to upper section 102 of mandrel nut 32 with upper end 148 of flanged end section 142 abutting against shoulder 110 of mandrel nut 32. Middle section 138 may extend through lower spring spacer 30 and upper spring spacer 22 terminating at upper section 136 positioned above upper spring spacer 22. Spring 24 may extend around outer surface 134 of middle section 138. Middle section 138 may include enlarged outer diameter section 150 in relation to the outer diameters of each of the end portions 152 of middle section 138. Upper section 136 may be positioned within inner bore 40 of upper body 12 and may be operatively connected to spring nut 20.

FIGS. 1A, 1B, and 4 depict spring nut 20. Spring nut 20 may be tubular in design with inner bore 154 defined by inner bore wall 156. Spring nut 20 may include outer surface 158. Inner bore wall 156 may divided by shoulder 160 into upper section 162 and lower section 164. Lower section 164 may be operatively connected (e.g. by threaded connection) to upper section 136 of spring mandrel 28. For example, lower section 164 may contain threads that mate with threads on upper section 136. Shoulder 160 may include top edge 166 and bottom edge 168. Upper edge 170 of upper section 136 of spring mandrel 28 abuts against bottom edge 168 of shoulder 160. Upper section 162 terminates at top edge 172. Spring nut 20 may be operatively positioned within inner bore 40 of upper body 12.

As seen in FIGS. 1A, 1B, and 4, compression nut 18 may be operatively positioned within inner bore 40 of upper body 12. Compression nut 18 may include outer surface 174 and inner bore 176 defined by inner bore wall 178. Outer surface 174 of compression nut 18 may be fixedly attached to inner bore wall 42 of upper body 12. Compression nut 18 may be dimensioned so as to receive upper section 162 of spring nut 18. Compression nut 18 may include upper edge 180 and bottom edge 182.

FIGS. 1A, 1B, and 4 show outer valve sleeve 14. Outer valve sleeve 14 may be tubular in design with inner bore 184 defined by inner bore wall 186. Outer valve sleeve 14 may include outer surface 188. Outer valve sleeve 14 may include upper section 190, middle section 192, and lower section 194. The outer diameter of each of upper section 190 and lower section 194 may be the same and may be enlarged in relation to the outer diameter of middle section 192. Outer valve sleeve 14 may be operatively positioned within inner bore 40 of upper body 12. Upper section 190 may terminate at upper edge 196 that abuts against shoulder 198 in inner bore wall 42 of upper body 12 with outer surface 188 of upper section 190 abutting against inner bore wall 42 of upper body 12. Lower section 194 terminates at bottom edge 200 which abuts against upper edge 180 of compression nut 18. Middle section 192 may include one or more apertures 202 providing a fluid flow passage from inner bore 184 to space 204 between outer surface 188 of middle section 192 and inner bore wall 42 of upper body 12. Upper body 12 may include one or more apertures 206 providing a fluid flow passage from space 204 to the annulus in the wellbore (not shown). Each of upper and lower sections 190, 194 may be sealingly connected to inner bore wall 42 of upper body 12. For example, outer surface 188 at each of upper and lower sections 190, 194 may include recess 195 for placement of seals such as O-ring 197.

As referenced in FIGS. 1A, 1B, and 4, inner valve sleeve 16 may be tubular in design with inner bore 208 defined by inner bore wall 210. Inner valve sleeve 16 may include outer surface 212. Inner valve sleeve 16 may include upper end 214 and lower end 216. Inner valve sleeve 16 may be operatively positioned such that it extends from inner bore 184 of outer valve sleeve 14 through inner bore 176 of compression nut 18 and into inner bore 154 of spring nut 20. Lower end 216 abuts against top edge 166 of shoulder 160 of spring nut 20. The inner valve sleeve 16 is operatively fixed to the spring nut 20. In the "No WOB" position of assembly 10 shown in FIG. 1: outer surface 212 of upper section 218 of inner valve sleeve 16 abuts against inner bore wall 42 of upper body 12; outer surface 212 of middle section 220 of inner valve sleeve 16 sets adjacent to inner bore wall 178 of compression nut 18; and outer surface 212 of lower section 222 of inner valve sleeve 16 abuts against inner bore wall 156 of upper section 162 of spring nut 20. Upper section 218 may contain one or more apertures 224 providing a fluid passageway from inner bore 208 to aperture(s) 202 in outer valve sleeve 14 when aperture(s) 224 and aperture(s) 202 are aligned. Inner valve sleeve 16 may be sealingly engaged with outer valve sleeve 14. For example, inner bore wall 210 of outer valve sleeve 14 may contain recesses 199 operatively positioned above and below aperture 202 with a seal, such as O-rings 201, partially accommodated in respective recesses 199 for forming a seal between inner bore wall 210 of outer sleeve 14 and outer surface 212 of inner sleeve 16.

As mentioned above, FIGS. 1A-4 depict assembly 10 in a configuration where the drill bit is not on the bottom of the wellbore and there is no WOB. Accordingly, the movable inner assembly comprising inner sleeve 16, spring nut 20, spring mandrel 28, lower spring spacer 30, mandrel nut 32, and spline mandrel 36, are in their fully extended or No WOB position in relation to the non-moving components of assembly 10, namely, upper body 12, outer valve sleeve 14, compression nut 18, upper spring spacer 22, spring housing 26 and spline body 34. In the No WOB position, spring 24 is fully expanded to the preloaded setting thereby forcing the moving inner assembly downward relative to the bottom of the wellbore. Therefore, shoulder 90 of spline mandrel 36 is at its farthest point away from lower edge 64 of spline body 34, top edge 172 of upper section 162 of spring nut 20 lies below bottom edge 182 of compression nut 18, and apertures 224 in upper section 218 of inner valve sleeve rests entirely below apertures 202 of outer valve sleeve 14. In this NO WOB configuration, drilling fluid pumped down the drilling string and into bore 40 of upper body 12 flows to the drill bit through inner bore 208 of inner valve sleeve 16, inner bore 50 of spring housing 26 and inner bore 72 of spine mandrel 36 without diversion through apertures 224 of inner valve sleeve 16 and apertures 202 of outer valve sleeve 14. In the absence of such diversion, the internal flow pressure of the drilling fluid is at its No WOB value.

FIGS. 5-8B show assembly 10 in a configuration where the drill bit has reached the bottom of the wellbore and some initial WOB force is being applied to the drill bit sufficient to overcome the expansion force of spring 24 and the bottom-hole assembly (BHA) pressure created by the pumping of drilling fluid through the drill string and assembly 10 to the drill bit. Accordingly, the movable inner assembly has moved upward relative the stationary components of assembly 10 resulting in shoulder 90 of spline mandrel 36 moving in the direction of and closer to lower edge 64 of spline body 34, top edge 172 of upper section 162 of spring nut 20 moving partially into inner bore 176 of compression nut 18, and apertures 224 in upper section 218 of inner valve sleeve moving in the direction of and closer to apertures 202 of outer valve sleeve 14.

FIGS. 9-11B show assembly 10 in the configuration where WOB has increased on the drill bit sufficient to further move the inner movable assembly parts to a partially valve open position (crack-open). Accordingly, shoulder 90 of spline mandrel 36 has moved even closer to lower edge 64 of spline body 34, top edge 172 of upper section 162 of spring nut 20 has moved further upward into inner bore 176 of compression nut 18, and apertures 224 in upper section 218 of inner valve sleeve have moved upward and are in partial alignment with apertures 202 of outer valve sleeve 14 (i.e. the top of apertures 224 are aligned with the bottom of apertures 202 such that some restricted fluid flow is now achievable through apertures 224, apertures 202 and into the annulus (not shown) through apertures 206 in upper body 12). The restricted fluid flow into the annulus (not shown) causes an initial drop in the BHA pressure, reducing the effective countervailing force, thereby permitting the WOB to further overcome the expansion force of spring 24 and the BHA pressure to achieve full valve opening.

Figure 14:
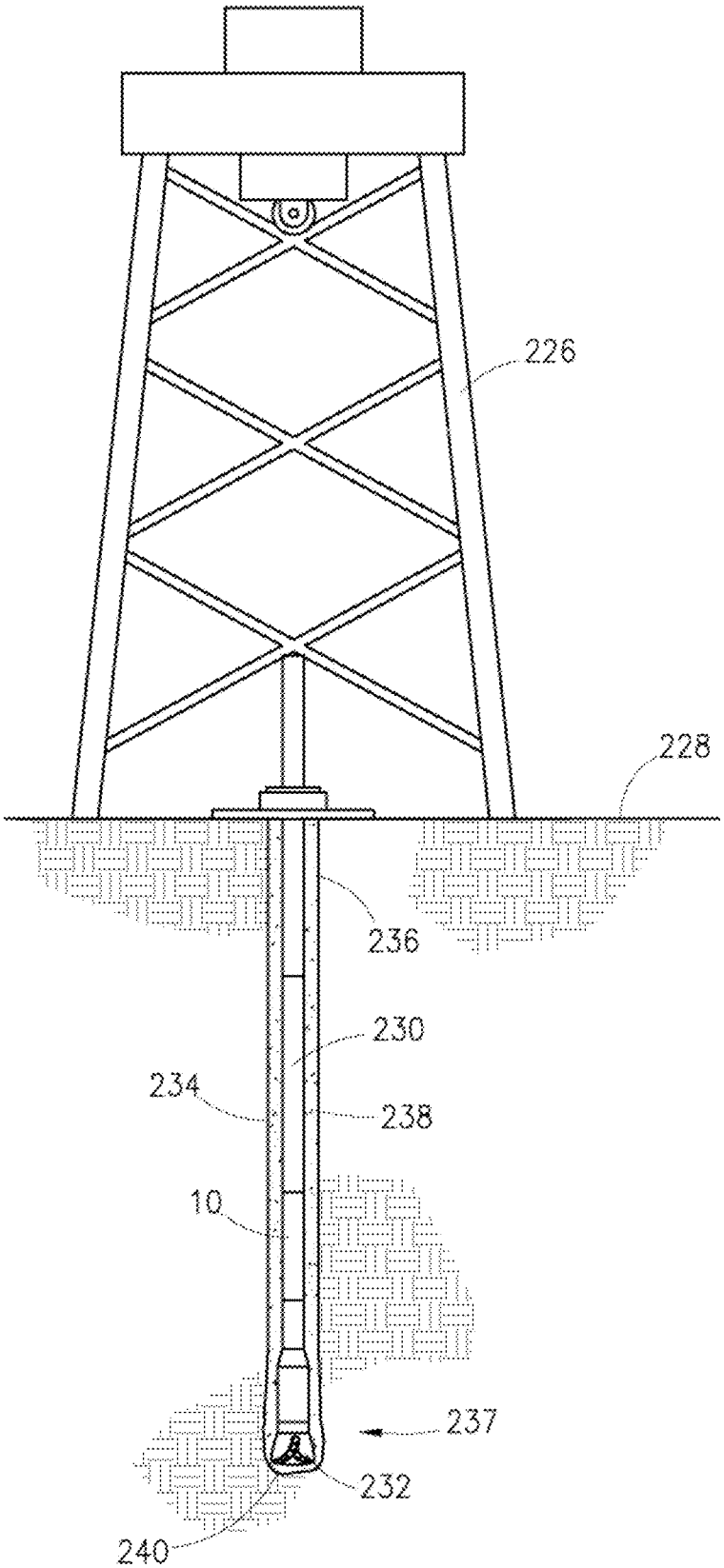
FIG. 14 is schematic representation of a wellbore drilling operation with the embodiment of the bit saver assembly of FIGS. 11A and 11B operatively connected to a drill string.

FIGS. 11A-14 show assembly 10 in the configuration where WOB has increased on drill bit 232, coupled with the reduction of BHA pressure, to further move the inner movable assembly parts to a full valve open position (latched-opened or max WOB). Accordingly, shoulder 90 of spline mandrel 36 has made contact with lower edge 64 of spline body 34, spring 24 is fully compressed, top edge 172 of upper section 162 of spring nut 20 has moved further upward into inner bore 176 of compression nut 18, and apertures 224 in upper section 218 of inner valve sleeve have moved upward and are in full alignment with apertures 202 of outer valve sleeve 14. BHA pressure is reduced to its lowest value as some of the drilling fluid flow is diverted through apertures 224, apertures 202 and into the annulus 236 through apertures 206 in upper body 12, as seen in FIG. 14.

FIG. 14 is a schematic representation of drilling operation employing assembly 10. Drilling rig 226 is positioned at well surface 228. Drill string 230 runs from drilling rig 226 into wellbore 234 and terminates at bottom hole assembly 237 with include drill bit 232, which is positioned on wellbore bottom 240. Assembly 10 is operatively connected in-line to drill string 230. As shown, assembly 10 is configured in its full valve open position (latched-open). Drilling fluid 238 is pumped down drill string 230 is partially diverted as described above and passes into annulus 236. It is to be understood that drill string 230 may be interconnected drill pipe or coiled tubing.

It is to be understood that the full open valve configuration of assembly 10 shown in FIGS. 11A-14 may be returned to the No WOB configuration by minimizing the applied WOB. For example, drill string 230 could be lifted by drilling rig 226 so that drill bit 232 is lifted off the wellbore bottom 240 to reduce or eliminate WOB. Accordingly, the movable inner assembly parts will return (move downward relative to the stationary parts of assembly 10) to the No WOB position via the expansion force of spring 24 and the BHA pressure.

FIG. 15 depicts the Distance Traveled Formula for determining the distance inner valve sleeve 16 (or any of the parts comprising the inner movable assembly) has moved based on values for WOB, Flow Pressure, Valve Area, Spring Rate, and Preload Distance. The formula can be used to determine the valve area (nozzle size), the initial spring, the initial spring spacer size for the spring pre-load and therefore the spring force necessary for setting up the Bit Saver for a particular WOB.

Figure 16:
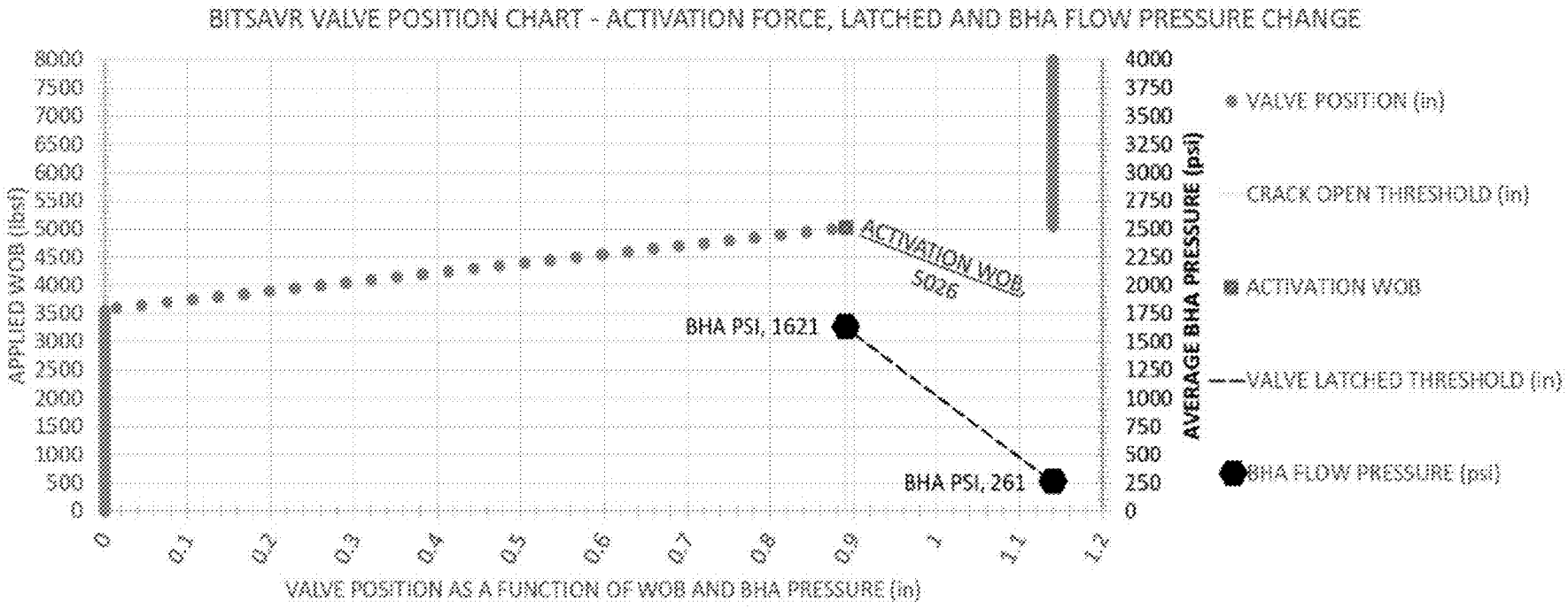
FIG. 16 is a graphic chart plotting Valve Position against Applied WOB and Average BHA Pressure for a simulated setting of the Bit Saver.

FIG. 16 is a representative graph chart plotting the data and results of the formula FIG. 15 such as Valve Position against Applied WOB and Average BHS Pressure. The chart can be used as a visual aid to see the function of the invention in a particular setting.

All parts comprising assembly 10 may be made of any material sufficiently durable to operate in a downhole environment. For example, assembly 10 may be fabricated from metal, such as steel except inner valve sleeve 14 and outer valve sleeve 16. Inner valve sleeve 14 and outer valve sleeve 16 are made out of high abrasion resistant materials such as Cermet (tungsten carbide) or ceramics (silicon nitride). The dimensions of the parts comprising assembly 10 may vary depending on operational parameters associated with the particular drilling operation.

When WOB is applied greater than (1) the preload force of spring 24 and (2) the flow psi*effective area of inner valve sleeve 16, the movable inner assembly (comprising spline mandrel 36, mandrel nut 32, lower spacer 30, spring mandrel 28, spring nut 20 and inner valve 16) begins to move upward relative to the stationary parts of assembly 10 while compressing spring 24. Once apertures 224 in upper section 218 of inner valve sleeve 16 reach and partially align with apertures 202 in outer valve sleeve 14, drilling fluid 238 begins to be bypassed to annulus 236 causing a reduction in BHA pressure (psi). When the pressure flow is reduced, the resulting force acting on the effective area of inner valve sleeve 16 is significantly reduced so that the movable inner assembly moves inner valve sleeve 16 into the fully opened position (latched open). When fully open, the drop in the flow pressure reduces the effective WOB by reducing the internal psi force acting on the BHA. This resulting pressure change can be seen by the operator on drilling rig 226 at well surface 228.

Dampening will occur during normal drilling and therefore minimizes any dynamic changes in WOB and "bit bounce" from inadvertently activating the tool. The dampening effect prevents quick reactions by the tool and occurs when the fluid captured in the cavity of the spring area tries to escape through the small annular gap between the mandrel nut 32 and the spring housing 26 and again through a second annular gap between the spline mandrel 36 and the spline body 34.

Assembly 10 functions automatically (without operator input); the operator sees a significant pressure drop. When the operator lifts drill string 230 (e.g. drill pipe or coiled tubing), the WOB is reduced lower than the spring force necessary to reach "crack-open" (minus the forces acting on inner valve sleeve 16 (the piston) that were lost when inner valve sleeve 16 was activated) and the pressure increases again.

Assembly 10 reduced WOB independently of an operator on the surface by reducing internal flow pressure when inner valve sleeve 16 opens and thereby reduces the stretch on drill string 230. Normally, closed latching (on-off, bi-stable, or position biased) valve uses internal pressure reduction to shift fully open. Assembly 10 sends a signal to the surface notifying the operator of excessive WOB. The operator reduces WOB by lifting drill string 230 causing the bypass to close automatically (i.e. expansion of spring 24, coupled with BHA pressure, causes inner valve sleeve 16 to move downward relative to outer valve sleeve 14 to misalign and close off apertures 224 and 202).

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. A bit saver assembly comprising:

an outer housing including an inner bore defined by an inner bore wall, the outer housing including one or more apertures for the passage of a drilling fluid to an annulus of a wellbore;

an outer valve sleeve including an inner bore defined by an inner bore wall, the outer valve sleeve operatively associated with the outer housing, the outer valve sleeve including one or more apertures for the passage of the drilling fluid;

an inner assembly selectively movable axially in relation to the outer valve sleeve and being partially contained within the inner bore of the outer housing, the inner assembly including an inner valve sleeve positioned within the inner bore of the outer valve sleeve, the inner valve sleeve including one or more apertures for the selective passage of the drilling fluid to the one or more apertures of the outer valve sleeve, the inner valve sleeve having a non-actuated position wherein the one or more apertures of the inner valve sleeve are not in fluid communication with the one or more apertures of the outer valve sleeve, and an actuated position wherein the one or more apertures of the inner valve sleeve are in fluid communication with the one or more apertures of the outer valve sleeve;

a biasing member positioned within the inner bore of the outer housing and operatively connected to the inner valve sleeve, the biasing member having a force; and wherein the inner assembly is operatively connected to a drill bit and configured to place the one or more apertures of the inner valve sleeve in the non-actuated position based on a weight-on-bit (WOB) force on the drill bit being less than a countervailing force comprising the force of the biasing member plus a drilling fluid flow pressure at an area proximate the inner valve sleeve and to place the one or more apertures of the inner valve sleeve in the actuated position based on a the WOB force being greater than the countervailing force.

2. The bit saver of claim 1, wherein the biasing member is a spring, and wherein the inner assembly includes a spring mandrel positioned within the inner bore of the outer housing, the spring mandrel is operatively connected to the inner valve sleeve and to the spring, the spring being positioned around a portion of the spring mandrel.

3. The bit saver of claim 2, wherein the inner assembly includes a spline mandrel, the spline mandrel partially positioned within the inner bore of the outer housing, the spline mandrel having an upper end operatively contacting a lower end of the spring mandrel, the spline mandrel having a lower end operatively connected to the drill bit.

4. The bit saver of claim 3, wherein the inner assembly includes a mandrel nut operatively positioned within the bore of the outer housing between the upper end of the spline mandrel and the inner bore wall of the outer housing, the mandrel nut being directly connected to the upper end of the spline mandrel and movable therewith, the mandrel nut configured to hold the lower end of the spring mandrel onto the upper end of the spline mandrel.

5. The bit saver assembly of claim 4, wherein the inner assembly includes a lower spring spacer operatively positioned within the inner bore of the outer housing between the spring mandrel and the inner bore wall of the outer housing, a bottom end of the lower spring spacer contacting an upper end of the mandrel nut and movable therewith, an upper end of the spring spacer contacting a lower end of the spring.

6. The bit saver assembly of claim 5, further comprising an upper spring spacer operatively positioned within the inner bore of the outer housing, the upper spring spacer being affixed to the outer housing, a lower end of the upper spring spacer contacting an upper end of the spring.

7. The bit saver assembly of claim 6, wherein the inner assembly includes a spring nut operatively positioned within the inner bore of the outer housing partially between the spring mandrel and the inner bore wall of the outer housing, the spring nut directly connected to an upper end of the spring mandrel.

8. The bit saver assembly of claim 7, further comprising a compression nut fixedly attached to the inner bore wall of the outer housing, the compression nut having an inner bore defined by an inner bore wall, the inner bore of the compression nut dimensioned to receive an upper section of the spring nut when the inner valve sleeve is in the actuated position.

9. The bit saver assembly of claim 8, wherein the upper section of the spring nut is directly connected to a lower end of the inner valve sleeve.

10. The bit saver assembly of claim 3, wherein the upper end of the spline mandrel includes a seal, the seal providing a sealed connection between the spline mandrel and mandrel nut.

11. The bit saver assembly of claim 3, wherein the portion of the lower end of the spline mandrel not contained within the inner bore of the outer housing includes a rib, the rib having an upper shoulder that abuts with the lower terminating edge of the outer housing when the inner valve sleeve is in the actuated position.

12. The bit saver assembly of claim 1, wherein the upper end of the outer valve sleeve contains a seal and the lower end of the outer valve sleeve contains a seal, the seals providing a sealed connection between the outer valve sleeve and the outer housing, and wherein the one or more apertures of the outer valve sleeve are positioned between the seals of the upper and lower ends of the outer valve sleeve.

13. The bit saver assembly of claim 1, wherein the outer housing comprises an upper body, a biasing-member housing, and a spline body, a lower end of the upper body directly connected to an upper end of the biasing-member housing, and a lower end of the biasing-member housing directly connected to an upper end of the spline body.

14. A method of managing a weight-on-bit (WOB) force on a drill bit during a drilling operation comprising the steps of:

running a drill string down a wellbore, the drill string terminating at a bottom-hole assembly (BHA) that includes the drill bit, the drill string including a bit saver assembly operatively positioned above the BHA;

placing the drill bit in contact with the bottom of the wellbore;

causing the drill bit to bore into the bottom of the wellbore, the drill bit being subjected to the WOB force;

wherein when the WOB force on the drill bit is greater than a countervailing force comprising a force generated in the bit saver assembly plus a drilling fluid flow pressure force, the bit saver assembly transitions from a non-actuated state to an actuated state; and wherein in the actuated state, the bit saver assembly varies the drilling fluid pressure to vary the WOB force on the drill bit.

15. The method of claim 14, wherein in the actuated state, the bit saver assembly reduces the drilling fluid pressure to decrease the WOB force on the drill bit.

16. The method of claim 14, further comprising the step of:

lifting the drill string in the wellbore up hole to reduce or eliminate the WOB force on the drill bit and cause the bit saver assembly to transition from the actuated state to the non-actuated state.

17. The method of claim 14, wherein in the non-actuated state, the bit saver assembly generates a dampening effect during drilling to minimize dynamic changes in the WOB force.

18. The method of claim 17, wherein in the non-actuated state, the bit saver assembly minimizes bit bounce to prevent the bit saver assembly transitioning from the non-actuated state to the actuated state.

19. The method of claim 14, wherein the bit saver assembly operates to vary the WOB force on the drill bit without requiring input from an operator.

20. The method of claim 14, further comprising the steps of:

the bit saver assembly sending a signal to an operator at a surface of the well, the signal indicating that an excessive WOB force has been achieved; and the operator causing a lifting of the drill bit off the bottom of the wellbore thereby reducing or eliminating the WOB force on the drill bit and causes the bit saver assembly to transition from the actuated state to the non-actuated state.

* * * * *